United States Patent [19]

Stonecliffe et al.

[11] Patent Number: 4,653,570

[45] Date of Patent: Mar. 31, 1987

[54] HORIZONTAL CONTINUOUS CASTING APPARATUS

[75] Inventors: David Stonecliffe; Peter Barlow, both of Sheffield, England

[73] Assignee: Davy McKee (Sheffield) Limited, Sheffield, England

[21] Appl. No.: 838,139

[22] Filed: Mar. 10, 1986

[30] Foreign Application Priority Data

Mar. 13, 1985 [GB] United Kingdom ..... 8506447

[51] Int. Cl.[4] ..... B22D 11/00

[52] U.S. Cl. ..... 164/440; 164/490

[58] Field of Search ..... 164/438–440, 164/490

[56] References Cited

U.S. PATENT DOCUMENTS 4,340,110 7/1982 Honda et al. ..... 164/440

FOREIGN PATENT DOCUMENTS 2013290 10/1970 Fed. Rep. of Germany .
2025764 2/1971 Fed. Rep. of Germany .
2100423 11/1972 Fed. Rep. of Germany .

*Primary Examiner*—Nicholas P. Godici
*Assistant Examiner*—Richard K. Seidel
*Attorney, Agent, or Firm*—Lee, Smith & Zickert

[57] ABSTRACT

Continuous casting apparatus comprises a mould defining a horizontal mould passage, a break ring having a tapered portion positioned in a correspondingly tapered inlet to the mould passage, a refractory feed tube supported in a mounting assembly and means for urging the assembly towards the mould so that an end face of the tube abuts against an end face of the break ring. The assembly is pivotally mounted so that the feed tube is pivotable relative to the break ring about a pair of axes which are at right angles to each other and at right angles to the longitudinal axis of the mould passage.

6 Claims, 3 Drawing Figures

HORIZONTAL CONTINUOUS CASTING APPARATUS

This invention relates to continuous casting apparatus in which the mould is arranged with its mould passage substantially horizontal.

It is well known for such apparatus to include a break ring at the inlet of the mould passage. The break ring, which is of a refractory material, such as silicon nitride, boron nitride, graphite or a ceramic, serves to provide a surface projecting into the mould passage from which the solidified skin of metal consistently breaks away as it is drawn through the mould passage. The break ring is subjected to very high temperatures where it is contacted by the molten metal and much lower temperatures where it is in contact with the cooled mould, consequently, the thermal stress which is set up in the material is considerable. It has been found that the stress can be contained and the break ring is less liable to be damaged if it is subjected to a radially inwardly acting compressive force. To this end, it has become the practice for the break ring to have a tapered portion which fits in a corresponding tapered inlet to the mould passage and for a force to be applied to the outer end face of the break ring to urge it into the tapered inlet of the mould passage so that the mould applies a radially compressive force to the break ring. It has also become the practice to mount a refractory tube in a mounting assembly which is urged towards the mould so that an end face of the feed tube abuts against the adjacent end face of the break ring and applies the force against it.

In modern continuous casting apparatus, it is desirable for the mould to be removable from the mould assembly so that a replacement mould, perhaps with a different size of mould passage, can be fitted. When the mould is replaced with one having a different mould passage, the break ring will also be replaced with one of a different size and, consequently, the size of the end face of the break ring will be different.

It is known for the feed tube to be mounted in an assembly which is hinged at one side of the feed tube to a fixed structure. In this way, the assembly and the feed tube can be pivoted about the hinge so that the feed tube is swung away from the mould in order to expose the mould inlet.

With such apparatus, it is difficult to ensure that uniform loading of the break ring takes place. When the mould tube defines a mould passage of small cross-section, the lever arm effect of the assembly from the hinge to the feed tube is increased as compared with the situation when the mould tube defines a mould passage of greater cross-section. Furthermore, the load applied to the break ring by the feed tube is applied through a smaller cross-section as the size of the break ring is decreased. Consequently, as the mould cross-section is reduced in size, it becomes more difficult to prevent damage to the break ring being caused by asymmetrical loading of the break ring.

It is an object of the present invention to provide continuous casting apparatus which overcomes this difficulty.

According to the present invention, continuous casting apparatus comprises a mould arranged with its mould passage substantially horizontal, a break ring having a tapered portion positioned in a tapered inlet to the mould passage, a refractory feed tube supported in a mounting assembly, means for urging the mounting assembly towards the mould such that an end face of the feed tube abuts against an end face of the break ring, and wherein the mounting assembly is such that the feed tube is pivotable relative to the break ring about a pair of axes which are at right angles to each other and at right angles to the longitudinal axis of the mould passage.

In order that the invention may be more readily understood, it will now be described, by way of example only, with reference to the accompanying drawings, in which.

Figure 1:
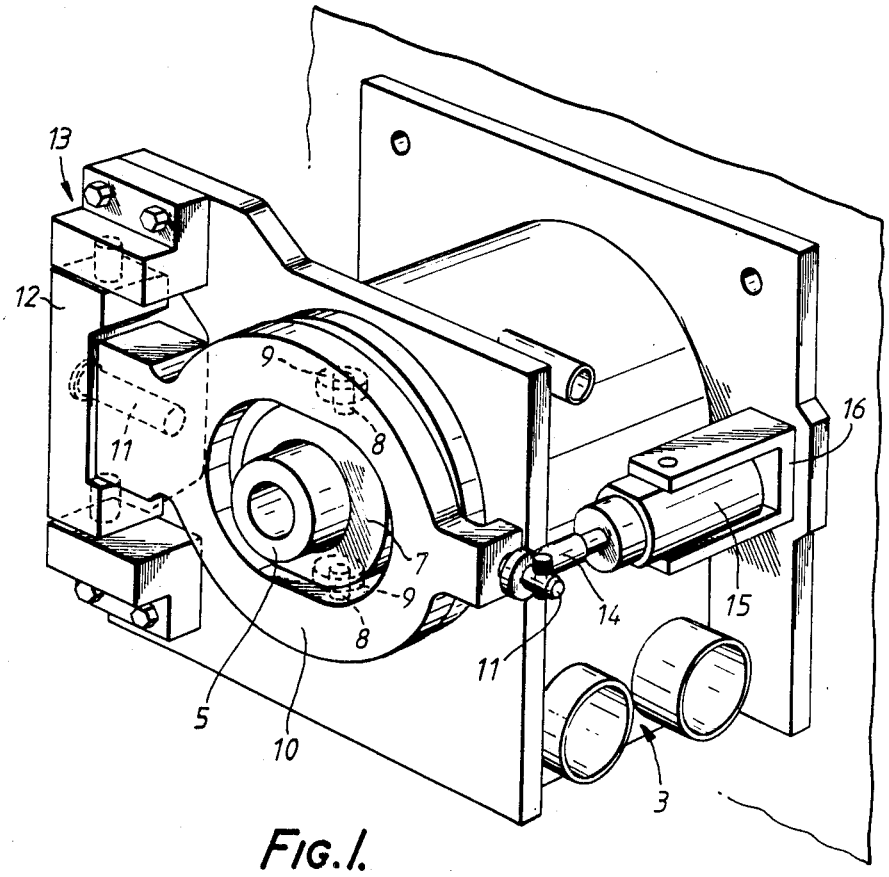
FIG. 1 is a perspective view of apparatus in accordance with the present invention.
Figure 2:
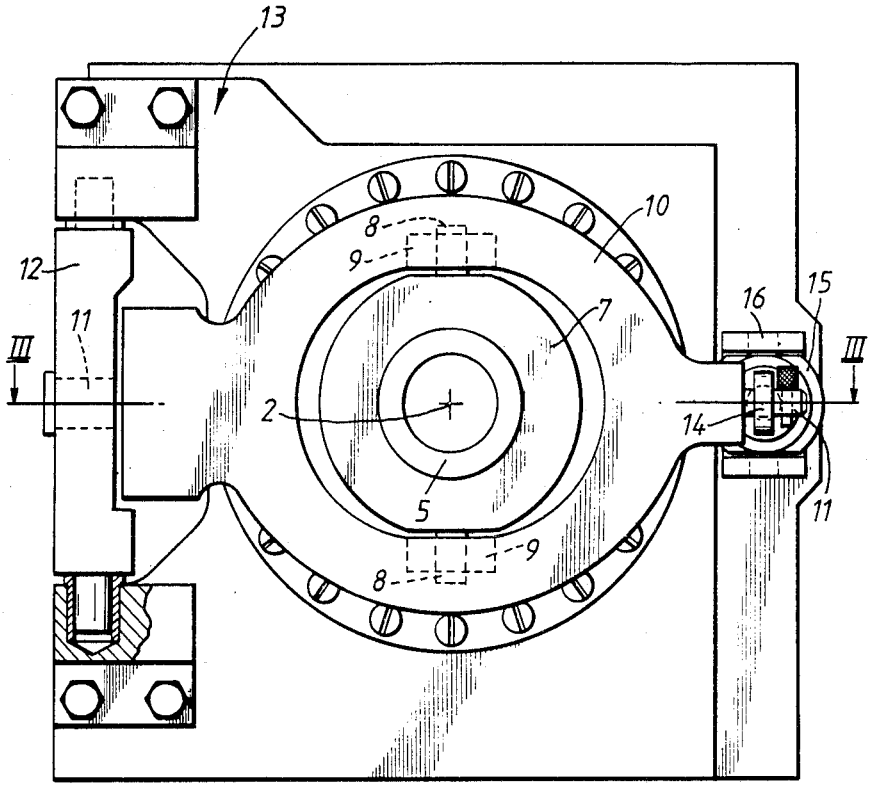
FIG. 2 is a front elevation.
Figure 3:
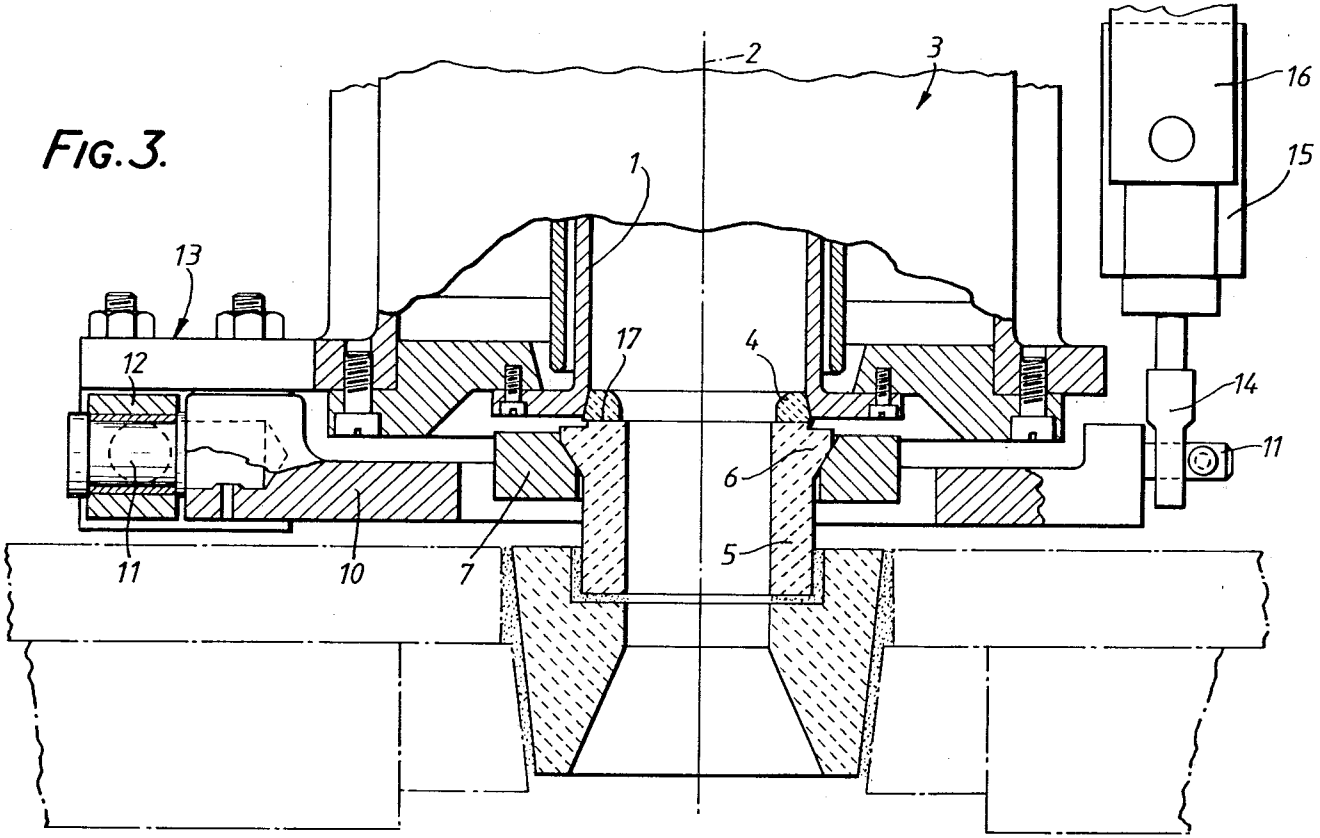
FIG. 3 is a section on the line III—III of FIG. 2.

A stationary continous casting mould assembly comprises a mould tube 1, conveniently of copper, arranged with its longitudinal axis 2 substantially horizontal and surrounded by a jacket 3 through which cooling liquid can be circulated into contact with the outer surface of the tube 1. The inlet end of the mould passage is tapered and a break ring 4 having a correspondingly tapered portion is positioned in the outlet of the mould passage. The break ring is formed from a refractory material, such as silicon nitride, boron nitride, silicon-aluminium oxynitride, graphite, cermets and other engineering ceramic materials.

By applying a force to the outside end face of the break ring, it is forced into the inlet of the mould passage and the tapers cause a compressive force to be applied to the periphery of the ring.

A refractory feed tube 5 has an outwardly extending tapered shoulder 6 and it is positioned in an opening in a first apertured metal plate 7. The tapered shoulder 6 of the feed tube co-acts with a corresponding taper on the plate 7. The plate carries a pair of aligned trunnions 8 which project in opposite directions from the upper and lower parts of the plate and these trunnions are rotatably mounted in blocks 9 which are attached to a second apertured metal plate 10. This plate has an opening through it and the feed tube 5 projects through the opening. The plate 10 is provided with a pair of aligned trunnions 11 which are arranged on an axis which is at right angles to the axis of the trunnions 8 and at right angles to the longitudinal axis 2 of the mould passage. One of the trunnions 11 is pivotable in a post 12 which, in turn, is hinged to a fixed structure 13 forming part of the mould assembly. The post is pivotable about an axis parallel to the pivot axis of the trunnions 8. The other trunnion 11 extends through a clevis pin 14 which is connected to the piston rod of a fluid operated piston-cylinder device 15. This device is pivotally secured to a bracket 16 which is attached to the fixed structure 13. By actuating the piston-cylinder device 15, the mounting assembly, consisting of the plates 7 and 10 and the feed tube 5, is urged towards the mould so that the end face 17 of the feed tube bears against the adjacent face of the break ring. As the plates can be pivoted in two planes which are mutually at right angles and both at right angles to the longitudinal axis of the mould, the force applied by the feed tube is evenly distributed over the end face of the break ring. The force which is applied by the feed tube to the break ring is controlled by the piston-cylinder device 15. Because the end faces of the feed tube and the break ring vary in cross-section for different billet sizes, the force which is applied to the break ring must be controlled accordingly.

When it is necessary to change the mould passage or the break ring, or to service them in any way, it is a simple matter to disconnect the piston-cylinder device 15 from the trunnion 11 and to swing the mounting arrangement about the hinge, formed between the post 12 and the fixed structure, to a position which provides access to the mould passage and the break ring.

What we claim as our invention and desire to secure by Letters Patent is:

1. Continuous casting apparatus comprising a mould defining an open-ended mould passage arranged with a longitudinal axis of the mould passage horizontal, the mould passage having a tapered portion at the inlet end;

a break ring having a correspondingly tapered peripheral portion located at the inlet end of the mould passage;

a rigid support structure;

a mounting assembly positioned at the inlet end of the mould passage and carried by the support structure, including means for pivoting said assembly with respect to the support structure about a pair of axes which are at right angles to each other and at right angles to the longitudinal axis of the mould passage;

a refractory feed tube supported by the mounting assembly; and means for urging the mounting assembly towards the mould such that an end face of the feed tube abuts against an end face of the break ring.

2. Continuous casting apparatus as claimed in claim 1, wherein the mounting assembly comprises a first apertured plate in which the feed tube is located;

a second apertured plate supporting the first apertured plate with the first plate being pivotable with respect to the second plate about one of said pair of axes; and a support structure supporting the second apertured plate with the second plate being pivotable with respect to the support structure about the other of said pair of axes.

3. Continuous casting apparatus as claimed in claim 2, wherein the support structure includes a hinged post on which the second plate is pivotally mounted, said post permitting the mounting assembly to be pivoted towards and away from the inlet end of the mould passage.

4. Continuous casting apparatus as claimed in claim 1, in which the means for urging the mounting assembly towards the mould comprises a fluid operable piston-cylinder device.

5. Continuous casting apparatus as claimed in claim 3, in which the second plate has a pair of aligned trunnions, one of which is pivotally mounted in said post and the other is pivotally mounted in a clevis pin, said pin being connected to the piston rod of a fluid operable piston-cylinder device, said piston-cylinder device constituting the means for urging the mounting assembly towards the mould.

6. Continuous casting apparatus comprising a stationary mould assembly including a mould defining an open-ended mould passage, the mould being arranged with the longitudinal axis of the mould passage horizontal, the mould passage having a tapered portion at the inlet end;

a break ring having a correspondingly tapered peripheral portion located at the inlet end of the mould passage;

a refractory feed tube located in and extending through a first apertured plate;

a second apertured plate supporting the first apertured plate with the first plate being pivotable with respect to the second plate about a first axis which is at right angles to the longitudinal axis of the mould passage;

the second apertured plate having a pair of aligned trunnions which are pivotally mounted in a post and a clevis pin, respectively, which permit the second plate to pivot with respect thereto about a second axis which is at right angles to the first axis and to the longitudinal axis of the mould pasage;

said post being hinged to the mould assembly and pivotable about an axis parallel to said first axis;

said clevis pin being connected to the piston rod of a fluid operable piston-cylinder device mounted on the mould assembly and which serves to urge the feed tube towards the mould such that an end face of the feed tube abuts against an end face of the break ring.

* * * * *